US011392064B2

(12) United States Patent
Jinkoma

(10) Patent No.: US 11,392,064 B2
(45) Date of Patent: Jul. 19, 2022

(54) IMAGE FORMING APPARATUS CAPABLE OF INCREASING GLOSS LEVEL OF TONER IMAGE WITHOUT INCREASING NUMBER OF PROCESSES PERFORMED BY FIXING UNIT

(71) Applicant: CANON KABUSHIKI KAISHA, Tokyo (JP)

(72) Inventor: Yusuke Jinkoma, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/817,417

(22) Filed: Mar. 12, 2020

(65) Prior Publication Data

US 2020/0310308 A1 Oct. 1, 2020

(30) Foreign Application Priority Data

Mar. 27, 2019 (JP) ..... JP2019-061879
Feb. 4, 2020 (JP) ..... JP2020-017483

(51) Int. Cl.

| | |
|---|---|
| ***G03G 15/20*** | (2006.01) |
| ***G03G 15/00*** | (2006.01) |
| ***G03G 15/16*** | (2006.01) |
| ***G03G 15/23*** | (2006.01) |

(52) U.S. Cl.

CPC ..... *G03G 15/2039* (2013.01); *G03G 15/167* (2013.01); *G03G 15/205* (2013.01); *G03G 15/2021* (2013.01); *G03G 15/2042* (2013.01); *G03G 15/235* (2013.01); *G03G 15/6585* (2013.01); *G03G 2215/00805* (2013.01)

(58) Field of Classification Search

CPC ..... G03G 15/2039; G03G 15/2021; G03G 15/2042; G03G 15/205; G03G 15/235; G03G 15/6582; G03G 2215/00426; G03G 2215/00805; G03G 2215/0081

USPC ..... 399/69, 341

See application file for complete search history.

(56) References Cited

U.S. PATENT DOCUMENTS

| | | | | |
|---|---|---|---|---|
| 6,078,760 | A * | 6/2000 | Abe | G03G 15/2064 399/322 |
| 6,679,600 | B1 * | 1/2004 | Regimbal | G03G 15/2064 347/102 |
| 7,395,021 | B2 * | 7/2008 | Tamura | G03G 15/6573 399/329 |
| 10,379,465 | B2 * | 8/2019 | Shiokawa | G03G 15/2028 |
| 2020/0257232 | A1 * | 8/2020 | Uetake | G03G 15/205 |

FOREIGN PATENT DOCUMENTS

| | | | |
|---|---|---|---|
| JP | 1-193884 | A | 8/1989 |
| JP | 10282835 | A | * 10/1998 |
| JP | 11-109783 | A | 4/1999 |
| JP | 11-109784 | A | 4/1999 |
| JP | 2002-328557 | A | 11/2002 |
| JP | 2017003908 | A | * 1/2017 |
| JP | 2017021171 | A | * 1/2017 |
| JP | 2018-4943 | A | 1/2018 |

* cited by examiner

*Primary Examiner* — Robert B Beatty

(74) *Attorney, Agent, or Firm* — Canon U.S.A., Inc. I.P. Division

(57) ABSTRACT

An image forming apparatus sets, in a case where a mode for executing a heating process a plurality of times is set, a target temperature of a fixing unit during a second heating process depending on image information about a toner image to be formed on a first surface of a recording medium immediately before a first heating process.

19 Claims, 10 Drawing Sheets

IMAGE FORMING APPARATUS CAPABLE OF INCREASING GLOSS LEVEL OF TONER IMAGE WITHOUT INCREASING NUMBER OF PROCESSES PERFORMED BY FIXING UNIT

BACKGROUND OF THE DISCLOSURE

Field of the Disclosure

The present disclosure relates to an image forming apparatus, such as a copying machine or a laser printer, using an electrophotographic recording method.

Description of the Related Art

An image forming apparatus using an electrophotographic recording method incorporates a fixing unit configured to fix a toner image formed on a recording medium onto the recording medium.

In general, a photographic image with a higher gloss level looks better and thus is preferred. A technique in which a fixing unit performs a plurality of heating and pressurization processes on a single recording medium having a toner image formed thereon, to thereby increase the gloss level of the toner image is known (Japanese Patent Application Laid-Open No. H11-109783).

The gloss level of a toner image can be increased to a certain level by increasing the number of heating and pressurization processes to be performed by the fixing unit. However, an increase in the number of processes leads to an increase in time required for completing a printing process.

SUMMARY OF THE DISCLOSURE

The present disclosure is directed to providing an image forming apparatus capable of increasing the gloss level of a toner image without increasing the number of processes performed by a fixing unit to improve the gloss level.

According to an aspect of the present disclosure, an image forming apparatus that forms a toner image on a recording medium includes an image forming unit configured to form a toner image on a recording medium, and a fixing unit configured to fix the toner image formed on the recording medium onto the recording medium by executing a heating process for heating the recording medium while the recording medium is nipped and conveyed by a fixing nip portion, the fixing unit including a heater, a first rotary member to be heated by the heater, and a second rotary member, the first rotary member and the second rotary member forming the fixing nip portion. The image forming apparatus is configured to set a mode for executing the heating process a plurality of times in a state where a first surface of the recording medium is in contact with the first rotary member after the toner image is formed on the first surface of the recording medium by the image forming unit. In a case where the mode is set, a target temperature of the fixing unit during a second heating process is set depending on image information about the toner image to be formed on the first surface of the recording medium immediately before a first heating process.

Further features and aspects of the present disclosure will become apparent from the following description of example embodiments with reference to the attached drawings.

DESCRIPTION OF THE EMBODIMENTS

First Example Embodiment

Figure 1:
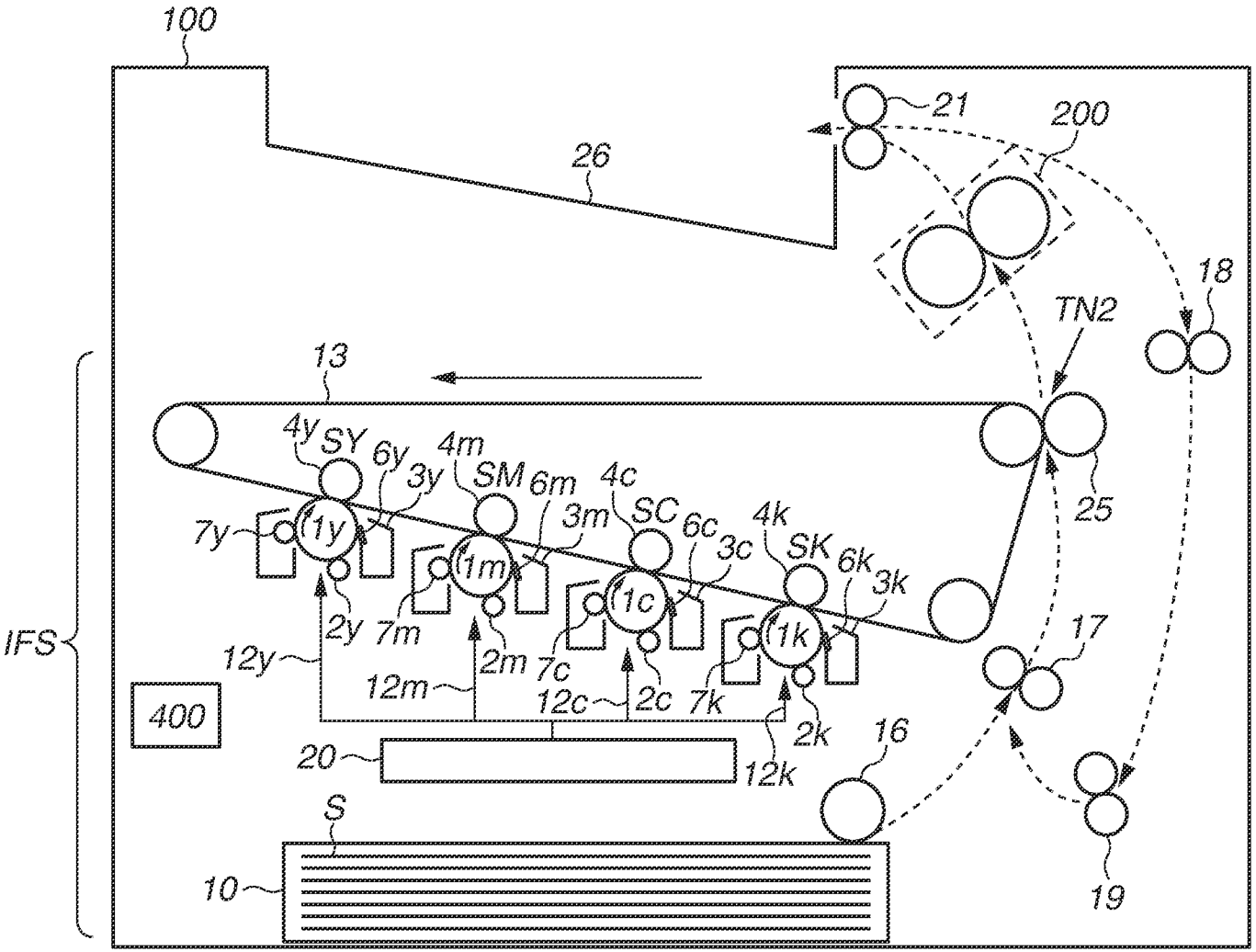
FIG. 1 illustrates a sectional view of an example image forming apparatus.

FIG. 1 is a sectional view illustrating an image forming apparatus 100 according to a first example embodiment that forms an image using an electrophotographic recording technique. The image forming apparatus 100 includes a first station SY, a second station SM, a third station SC, and a fourth station SK. These stations are arranged along a rotation direction of an intermediate transfer belt 13. The first station SY forms a yellow toner image. The second station SM forms a magenta toner image. The third station SC forms a cyan toner image. The fourth station SK forms a black toner image. Each of these stations is provided with a photosensitive drum (1*y*, 1*m*, 1*c*, or 1*k*), a charging roller (2*y*, 2*m*, 2*c*, or 2*k*), a development roller (7*y*, 7*m*, 7*c*, or 7*k*), and a primary transfer roller (4*y*, 4*m*, 4*c*, or 4*k*), as illustrated in FIG. 1. Each of these stations is also provided with a cleaner (6*y*, 6*m*, 6*c*, or 6*k*), and a waste toner container (3*y*, 3*m*, 3*c*, or 3*k*). A laser scanner 20 scans the photosensitive drums 1*y*, 1*m*, 1*c*, and 1*k* depending on image information. Laser beams 12*y*, 12*m*, 12*c*, and 12*k* are output from the laser scanner 20. A method for forming toner images by the electrophotographic recording technique using the above-described members is well known, and thus the detailed description thereof is omitted. The toner images are superimposed on the intermediate transfer belt 13 by the four stations SY, SM, SC and SK.

A recording medium S set on a cassette 10 is conveyed to a secondary transfer nip portion TN2 by a feed roller 16 and conveyance rollers 17. The second transfer nip portion TN2 is a portion where the intermediate transfer belt 13 and secondary transfer rollers 25 are in contact with each other. The toner images formed on the intermediate transfer belt 13 are transferred onto the recording medium S by the secondary transfer nip portion TN2. The members involved in the above-described process are included in an image forming unit IFS to form toner images on the recording medium.

The recording medium S on which the toner images are formed is conveyed to a fixing unit 200. The fixing unit 200 executes a heating process to heat the recording medium S while the recording medium S is nipped and conveyed by a fixing nip portion N (described below), thereby fixing the toner images formed on the recording medium S onto the recording medium S.

In a case of one-sided printing, the recording medium S that has undergone the fixing process by the fixing unit 200 and has passed through the fixing unit 200 is discharged onto a tray 26 by discharge rollers 21.

In a case of two-sided printing, after the toner images formed on a first surface of the recording medium S is fixed by the fixing unit 200, the recording medium S is conveyed in a direction in which the recording medium S is discharged onto the tray 26 by the discharge rollers 21. After a trailing edge of the recording medium S has passed through the fixing unit 200, the rotation direction of the discharge rollers 21 is reversed. The recording medium S is further conveyed to duplex conveyance rollers 18 by the discharge rollers 21, which are rotated backward, and is then conveyed to the conveyance rollers 17 again via duplex conveyance rollers 19. The toner images are then formed on a second surface of the recording medium S by the image forming unit IFS, and the toner images formed on the second surface are fixed by the fixing unit 200. The recording medium S is then discharged onto the tray 26.

(Example Configuration of Fixing Unit)

Figure 2:
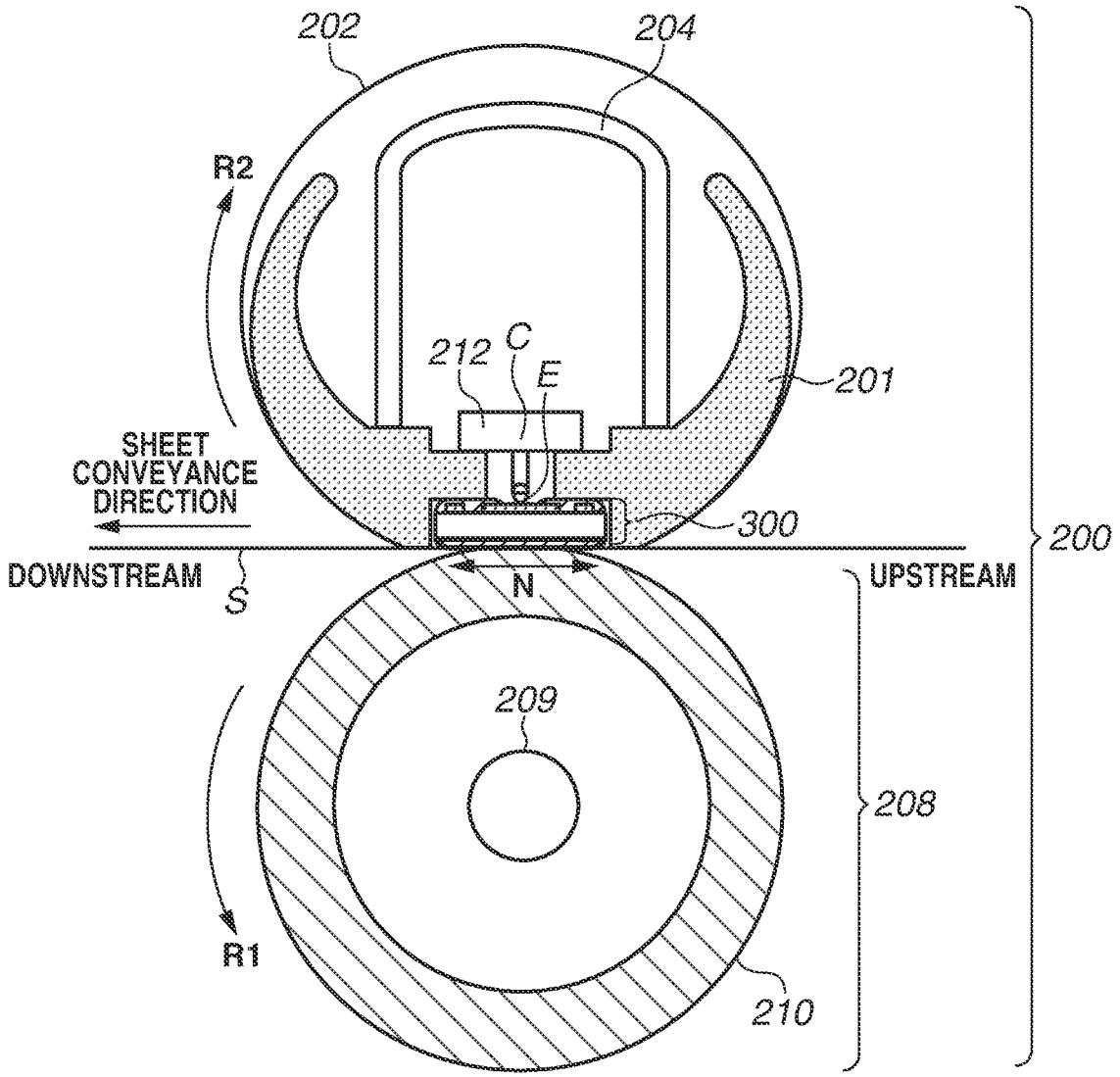
FIG. 2 illustrates a sectional view of an example fixing unit.

FIG. 2 illustrates a sectional view of the fixing unit 200. The fixing unit 200 includes a fixing film 202 serving as a first rotary member, and a heater 300 serving as a heat source contacted with an inner surface of the fixing film 202. The fixing unit 200 further includes a pressure roller 208 serving as a second rotary member. The pressure roller 208 and the heater 300 and form the fixing nip portion N via the fixing film 202. A heater holding member 201 is made of resin and holds the heater 300. The heater holding member 201 also has a fraction to guide the rotation of the fixing film 202. A stay 204 is made of metal (e.g., iron in the present example embodiment) and is used to reinforce the heater holding member 201.

The fixing film 202 is a tubular film having a base layer made of high-temperature resin (e.g., polyimide) or metal (e.g., stainless steel). A fluororesin layer is provided as a surface layer on the surface of the fixing film 202. An elastic layer made of silicone rubber or the like may be provided between the base layer and the surface layer.

The pressure roller 208 is a roller having a structure in which an elastic layer 210, which is made of silicone rubber or the like, is formed around a cored bar 209 made of iron (e.g., aluminum).

The heater 300 has a structure in which a heat generating resistor is printed on a ceramic substrate. Instead of using the ceramic substrate, the heater 300 may have a structure in which an insulating layer is provided on the surface of a substrate made of metal (e.g., aluminum), and a heating generating resistor is provided on the insulating layer. On a surface of the heater 300 that is opposite to the surface in contact with the fixing film 202, electrodes E (E1 to E7, E8-1, and E8-2) are provided. Power is supplied to the heat generating resistor through the electrodes E and electric contacts C (C1 to C7, C8-1, and C8-2) for power feeding.

A pressure is applied between the stay 204 and the pressure roller 208 by a force of a spring (not illustrated). This pressure enables the heater 300 and the pressure roller 208 to form the fixing nip portion N via the fixing film 202. A safety element 212, which functions as a thermal switch or a temperature fuse, is also provided for the heater 300 through a heater holding member 201. The safety element 212 is activated by abnormal heat generated by the heater 300, and stops power to be supplied to the heater 300.

The pressure roller 208 receives power from a motor (not illustrated) and rotates in a direction indicated by an arrow R1. When the pressure roller 208 rotates, the fixing film 202 is driven and rotated in a direction indicated by an arrow R2. The heating process for heating the recording medium S is executed while the recording medium S is nipped and conveyed by the fixing nip portion N, and thereby fixing the toner images formed on the recording medium S onto the recording medium S.

(Example Configuration of Heater)

Figure 3A:
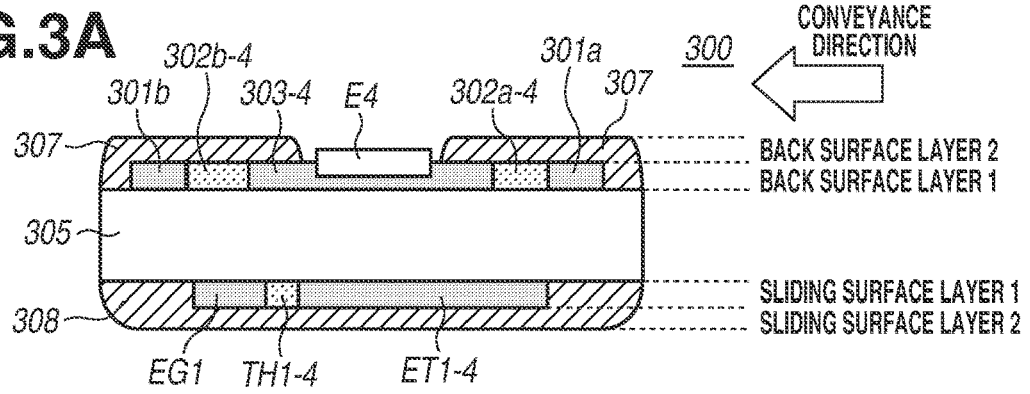
FIG. 3A illustrates a sectional view of an example heater.
Figure 3B:
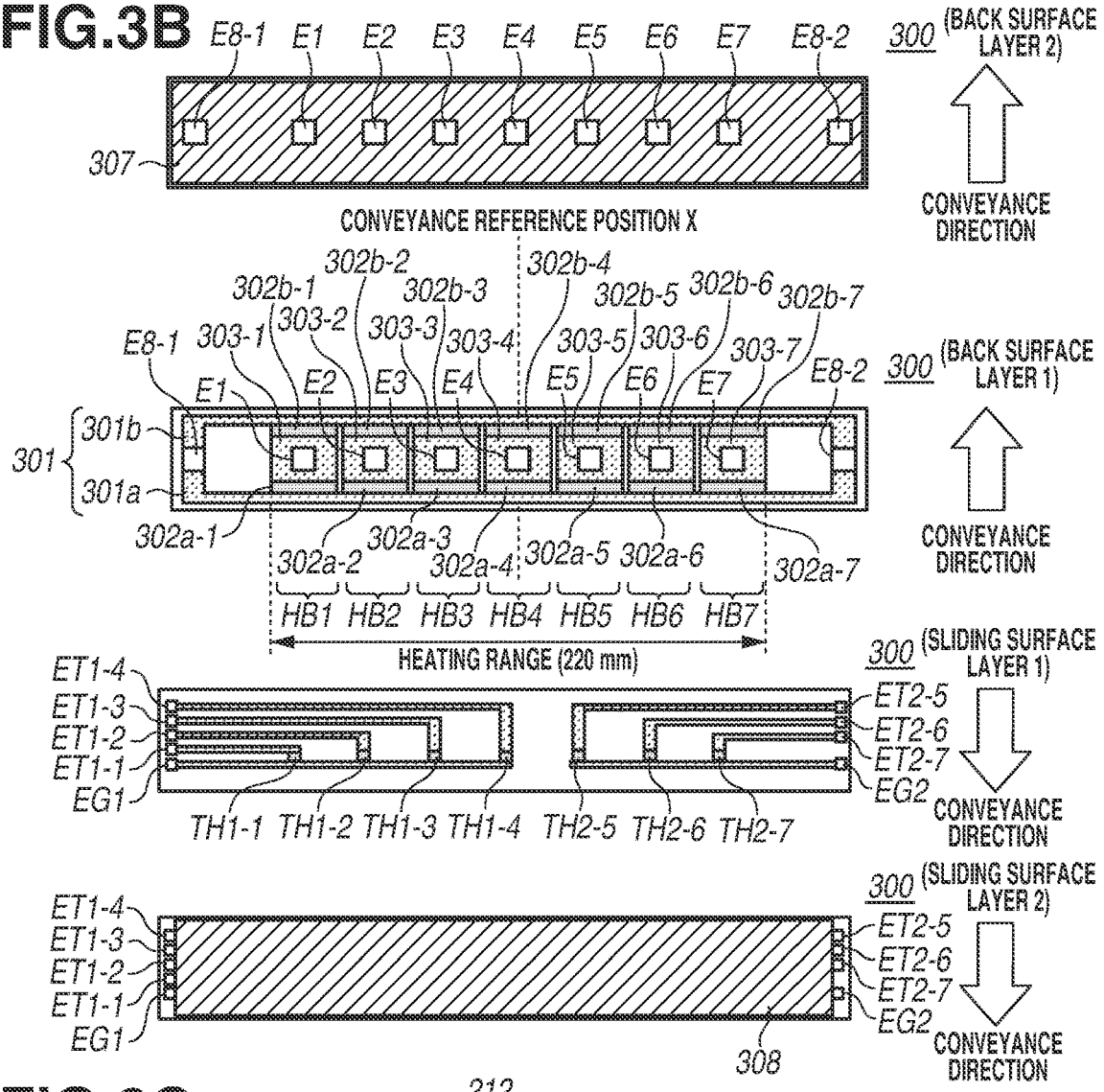
FIG. 3B illustrates a plan view of each layer of the heater.
Figure 3C:
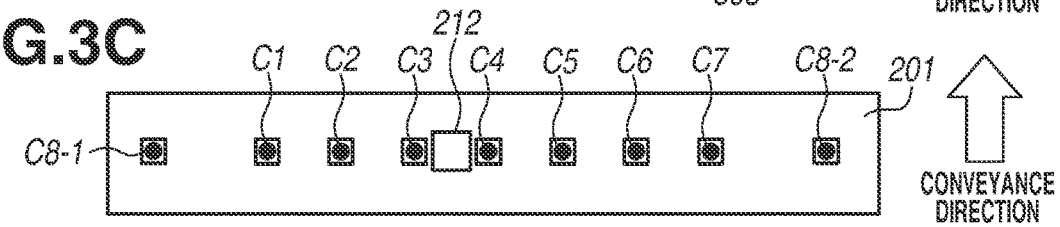
FIG. 3C illustrates an example connection configuration of each electric contact to the heater.

The configuration of the heater 300 according to the present example embodiment will be described with reference to FIGS. 3A to 3C. The heater 300 includes a plurality of heating blocks HB1 to HB7 arranged in a longitudinal direction of the heater 300. Each of the heating blocks HB1 to HB7 can be controlled independently. FIG. 3A illustrates a sectional view of the heater 300. FIG. 3B illustrates a plan view of each layer of the heater 300. FIG. 3C illustrates a connection configuration of each electric contact C to the heater 300.

FIG. 3B illustrates a conveyance reference position X for the recording medium S in the image forming apparatus 100 according to the present example embodiment. In the present example embodiment, a conveyance reference is set at a central position, and the recording medium S is conveyed such that the center of the recording medium S in a direction perpendicular to a conveyance direction of the recording medium S is set along the conveyance reference position X. FIG. 3A is a sectional view illustrating the heater 300 at the conveyance reference position X.

The heater 300 includes a ceramic substrate 305, a back surface layer 1 provided on the substrate 305, a back surface layer 2 that covers the back surface layer 1, a sliding surface layer 1 provided on a surface opposite to the back surface layer 1 on the substrate 305, and a sliding surface layer 2 that covers the sliding surface layer 1.

The back surface layer 1 includes a conductor 301 (301*a*, 301*b*) provided along the longitudinal direction of the heater 300. The conductor 301 is divided into conductors 301*a* and 301*b*. The conductor 301*b* is disposed at a downstream side of the conductor 301*a* in the conveyance direction of the recording medium S.

The back surface layer 1 also includes conductors 303 (303-1 to 303-7) provided in parallel to the conductors 301*a* and 301*b*. The conductors 303 are provided along the longitudinal direction of the heater 300 between the conductor 301*a* and the conductor 301*b*.

The back surface layer 1 also includes heating elements 302*a* (302*a*-1 to 302*a*-7) and heating elements 302*b* (302*b*-1 to 302*b*-7). The heating elements 302*a* are provided between the conductor 301*a* and the conductors 303. The heating elements 302*a* generate heat when power is supplied to the heating elements 302*a* through the conductor 301*a* and the conductors 303. The heating elements 302*b* are provided between the conductor 301*b* and the conductors 303. The heating elements 302*b* generate heat when power is supplied to the heating elements 302*b* through the conductor 301*b* and the conductors 303.

A heat generating section composed of the conductor 301, the conductors 303, the heating elements 302*a*, and the heating elements 302*b* is divided into seven heating blocks (HB1 to HB7) in the longitudinal direction of the heater 300. Specifically, the entire heating elements 302*a* are divided into seven regions, i.e., heating elements 302*a*-1 to 302*a*-7, in the longitudinal direction of the heater 300. The entire heating elements 302*b* are divided into seven regions, i.e., heating elements 302*b*-1 to 302*b*-7, in the longitudinal direction of the heater 300. The conductors 303 are divided into seven regions, i.e., conductors 303-1 to 303-7, depending on the position where the heating elements 302*a* and 302*b* are divided.

The image forming apparatus 100 according to the present example embodiment is an apparatus capable of forming images on A4-size recording media S. A letter size is a maximum standard size that can be used in the apparatus. A heating range of the heater 300 is a range from a left end of the heating block HB1 to a right end of the heating block HB7 as illustrated in FIG. 3B. The entire length of the heating range is 220 mm. The length of each heating block in the longitudinal direction is about 31 mm. However, the heating blocks may have different lengths.

The back surface layer 1 includes the electrodes E (E1 to E7, E8-1, and E8-2). The electrodes E1 to E7 are provided in the regions of the conductors 303-1 to 303-7, respectively. The electrodes E1 to E7 are used to supply power to the heating blocks HB1 to HB7 through the conductors 303-1 to 303-7, respectively. The electrodes E8-1 and E8-2 are provided to be connected to the conductor 301 at both ends in the longitudinal direction of the heater 300. The electrodes E8-1 and E8-2 are used to supply power to each of the heating blocks HB1 to HB7 through the conductor 301. In the present example embodiment, the electrodes E8-1 and E8-2 are respectively provided at both ends in the longitudinal direction of the heater 300. Alternatively, for example, only the electrode E8-1 may be provided at one side of the heater 300 in the longitudinal direction thereof. In the present example embodiment, a common electrode is used to supply power to the conductors 301*a* and 301*b*. Alternatively, individual electrodes may be provided for the conductor 301*a* and the conductor 301*b* to supply respective power to the conductor 301*a* and the conductor 301*b*.

The back surface layer 2 is composed of a surface protective layer 307 having insulating properties, and covers the conductor 301, the conductors 303, the heating elements 302*a*, and the heating elements 302*b*. The surface protective layer 307 according to the present example embodiment is made of glass. The surface protective layer 307 is formed on in area excluding areas corresponding to the electrodes E, and is configured to connect the electric contacts C to the electrodes E from the back surface layer 2 of the heater 300.

The sliding surface layer 1 provided on the surface opposite to the back surface layer 1 on the substrate 305 includes thermistors TH (TH1-1 to TH1-4 and TH2-5 to TH2-7) for detecting temperatures of the heating blocks HB1 to HB7. The thermistors TH are made of a material having positive temperature coefficient (PTC) characteristics or negative temperature coefficient (NTC) characteristics. The thermistors TH can detect the temperatures of the heating blocks by detecting resistance values of the heating blocks.

The sliding surface layer 1 includes conductors ET (ET1-1 to ET1-4 and ET2-5 to ET2-7) and conductors EG (EG1, EG2), which are electrically connected to the thermistors TH. The conductors ET1-1 to ET1-4 are connected to the thermistors TH1-1 to TH1-4, respectively. The conductors ET2-5 to ET2-7 are connected to the thermistors TH2-5 to TH2-7, respectively. The conductor EG1 is connected to the four thermistors TH1-1 to TH1-4 and forms a common conductive path. The conductor EG2 is connected to the three thermistors TH2-5 to TH2-7 and forms a common conductive path. The conductors ET and the conductors EG are formed between longitudinal ends along the longitudinal direction of the heater 300, and are connected to a control circuit 400 via electric contacts (not illustrated) at longitudinal ends of the heater 300.

The sliding surface layer 2 is composed of a surface protective layer 308 having sliding properties and insulating properties. The sliding surface layer 2 covers the thermistors TH, the conductors ET, and the conductors EG, and secures the sliding properties with the inner surface of the fixing film 202. The surface protective layer 308 according to the present example embodiment is made of glass. The surface protective layer 308 is formed in an area excluding the both end portions in the longitudinal direction of the heater 300 so that electric contacts can be provided for the conductors ET and the conductors EG.

Next, a method for connecting the electric contacts C for power supply to the respective electrodes E will be described. FIG. 3C is a plan view illustrating a state where the electric contacts C are connected to the respective electrodes E as viewed from the heater holding member 201. The heater holding member 201 is provided with trough-holes at positions corresponding to the electrodes E (E1 to E7, E8-1, and E8-2). The electric contacts C (C1 to C7, C8-1, and C8-2) are connected to the electrodes E (E1 to E7, E8-1, and E8-2) via the through-holes by a method such as urging by a spring, or welding. The electric contacts C are connected to the control circuit 400 of the heater 300 described below through a conductive material (not illustrated) provided between the stay 204 and the heater holding member 201.

(Example Configuration of Heater Control Circuit)

Figure 4:
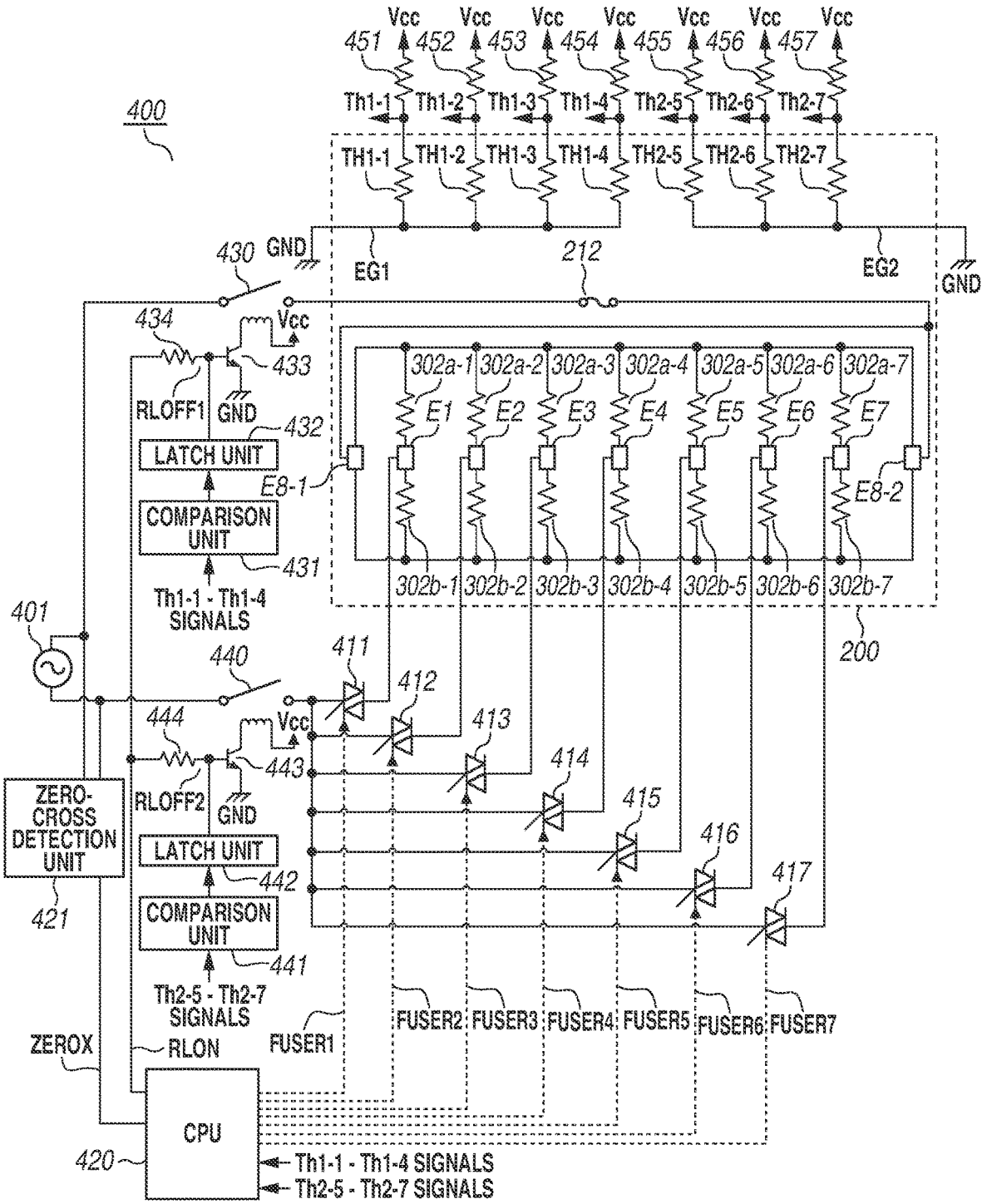
FIG. 4 illustrates a diagram of an example control circuit of the heater.

FIG. 4 illustrates the control circuit 400 configured to control the heater 300. An alternating current (AC) power supply 401 is a commercial AC power supply to be connected to the image forming apparatus 100. Power supply for the heater 300 is controlled by supplying or interrupting a current to triacs 411 to 417. The triacs 411 to 417 operate according to FUSER1 to FUSER7 signals supplied from a central processing unit (CPU) 420. Driving circuits for the triacs 411 to 417 are omitted in FIG. 4.

The control circuit 400 includes the seven triacs 411 to 417 each of which connected to the seven heating blocks HB1 to HB7, respectively. Accordingly, the seven heating blocks HB1 to HB7 can be controlled independently.

A zero-cross detection unit 421 is a circuit configured to detect a zero-cross point of the AC power supply 401, and outputs a ZEROX signal to the CPU 420. The ZEROX signal is a reference signal for the FUSER1 to FUSER7 signals and the like.

Next, a method for detecting the temperature of the heater 300 will be described. The temperature of the heater 300 is detected by the thermistors TH (TH1-1 to TH1-4 and TH2-5 to TH2-7). Potentials divided by the thermistors TH1-1 to TH1-4 and resistors 451 to 454 are detected as signals Th1-1 to Th1-4 by the CPU 420. The CPU 420 converts signals Th1-1 to Th1-4 into temperatures. Similarly, potentials divided by the thermistors TH2-5 to TH2-7 and resistors 465 to 467 are detected as signals Th2-5 to Th2-7 by the CPU 420. The CPU 420 converts the Th2-5 to Th2-7 signals into temperatures.

The CPU 420 calculates power to be supplied to the heater 300 based on the detected temperatures of the thermistors TH by using, for example, proportional integral (PI) control. The CPU 420 also controls the triacs 411 to 417 at a timing depending on the calculated power.

A relay 430 and a relay 440 are used to interrupt the power supply to the heater 300 when the temperature of the heater 300 becomes extremely high due to a failure or the like. When a RLON signal is in a high state, a transistor 433 is turned on and a current is supplied from a power supply voltage Vcc to a secondary-side coil of the relay 43. Thus, a primary-side contact of the relay 430 is turned on. When the RLON signal is in a low state, the transistor 433 is turned off and the supply of the current from the power supply voltage Vcc through the secondary-side coil of the relay 430 is interrupted. Thus, the primary-side contact of the relay 430 is turned off. Similarly, when the RLON signal is in a high state, a transistor 443 is turned on and a current is supplied from the power supply voltage Vcc to a secondary-side coil of the relay 440. Thus, a primary-side contact of the relay 440 is turned on. When the RLON signal is in a low state, the transistor 443 is turned off and the supply of the current from the power supply voltage Vcc through the secondary-side coil of the relay 440 is interrupted. Thus, the primary-side contact of the relay 440 is turned off. Resistors 434 and 444 are current-limiting resistors.

Next, an operation of a safety circuit using the relays 430 and 440 will be described. If any one of the temperatures detected by the thermistors TH1-1 to TH1-4 exceeds a predetermined value, which is set for each of the thermistors TH1-1 to TH1-4, a comparison unit 431 causes a latch unit 432 to operate. The latch unit 432 latches a RLOFF1 signal as a low state. When the RLOFF1 signal becomes the low state, the transistor 433 is maintained in an OFF state even when the CPU 420 brings the RLON signal into a high state. Thus, the relay 430 can maintain the OFF state (safe state). In a non-latched state, the latch unit 432 outputs the RLOFF1 signal to allow the relay 430 to open. The operation of the relay 440 is similar to that of the relay 430, and thus the description thereof is omitted.

The image forming apparatus 100 according to the present example embodiment can set not only a normal printing mode (e.g., one-sided printing mode, and two-sided printing mode), but also a gloss mode for improving the gloss level of an image. The image forming apparatus 100 can also set a high-gloss mode in which the heating process is executed a plurality of times in a state where the first surface of the recording medium S is in contact with the fixing film 202 after the image forming unit IFS forms the toner images on the first surface of the recording medium S.

(Example One-Sided Printing Mode/Two-Sided Printing Mode)

In a case of executing a normal printing mode (e.g., one-sided printing mode, and two-sided printing mode), the recording medium S is conveyed at a speed of 300 mm/s. The present example embodiment illustrates a case where toner images are formed on each letter-size recording medium S in all of one-sided printing mode, two-sided printing mode, and the gloss mode and high-gloss mode described below. The fixing unit 200 according to the present example embodiment switches a heating distribution depending on the size of the recording medium S. In a case of performing the heating process on the letter-size recording medium S, heating is controlled such that a target temperature for all the seven heating blocks HB1 to HB7 are set to a target temperature suitable for the fixing process.

In one-sided printing mode, a target temperature of the fixing unit 200 is set to 210° C. In the present example embodiment, the target temperature corresponds to a target temperature for a heating block corresponding to a region through which the recording medium S passes.

When two-sided printing mode is selected, a target temperature of the fixing unit 200 during the heating process on the first surface of the recording medium S is set to 210° C. The target temperature of the fixing unit 200 during the heating process on the second surface of the recording medium S is set to 200° C. In a case of fixing the toner images on the second surface, the temperature of the recording medium S is already high because of the heating process performed on the first surface. Accordingly, fixing properties of the toner images on the second surface can be secured even when the target temperature is lower than that for the first surface.

(Gloss Mode)

The gloss mode is a mode for increasing the gloss level of toner images by heating the toner images to a sufficiently high temperature (increasing the amount of heat) while conveying the recording medium S at a low speed. In a case of executing the gloss mode, the conveyance speed of the recording medium S is set to 100 mm/s. In the gloss mode for one-sided printing, the target temperature of the fixing unit 200 is set to 190° C. When the gloss mode for two-sided printing is selected, the target temperature during the heating process on the first surface of the recording medium S is set to 190° C., and the target temperature during the heating process on the second surface is set to 180° C. As a target temperature of the fixing unit 200 to be set when the gloss mode is selected, a temperature at which a highest possible gloss level can be obtained without causing hot offset of toner is set.

(High-Gloss Mode)

The image forming apparatus 100 can set the high-gloss mode for obtaining a higher gloss level than that in the gloss mode. In a case of executing the high-gloss mode, the conveyance speed of the recording medium S is set to 100 mm/s. The high-gloss mode is a mode in which the heating process is executed a plurality of times in a state where the first surface of the recording medium S is in contact with the fixing film 202 after the image forming unit IFS forms the toner images on the first surface of the recording medium S depending on image information.

In the high-gloss mode for one-sided printing, an unfixed toner image is first transferred onto the first surface of the recording medium S in the same manner as in normal one-sided printing, and the fixing process (heating process) is performed by the fixing unit 200. Thereafter, like in normal two-sided printing, the recording medium S is reversely conveyed by the discharge rollers 21, passes through a duplex conveyance path in which the duplex conveyance rollers 18 are disposed, and is then conveyed to a secondary transfer portion again. On the second surface of the recording medium S, image formation is not performed, and the recording medium S is directly conveyed to the fixing unit 200. In a case of normal two-sided printing, the recording medium S is directly discharged by the discharge rollers 21. However, in the high-gloss mode, the discharge rollers 21 are rotated backward again in a state where the recording medium S is nipped, and the recording medium S is conveyed to the duplex conveyance rollers 18. The recording medium S passes through the secondary transfer portion again and is heated by the fixing unit 200, and is then discharged to the outside of the image forming apparatus 100 by the discharge rollers 21. In other words, if the high-gloss mode for one-sided printing is selected, the recording medium S passes through the fixing unit 200 three times. During this process, the heating process is executed twice in a state where the first surface of the recording medium S is in contact with the fixing film 202.

As described above, the image forming apparatus 100 controls the recording medium S to be conveyed such that the same recording medium S passes through the duplex conveyance path twice, thereby bringing the first surface of the recording medium S into contact with the fixing film 202 during a second heating process.

As the number of times the recording medium S passes through the fixing unit 200 increases, a larger amount of heat and pressure can be applied to the toner images and the smoothness on the surface of the toner images increases, which leads to an increase in gloss level. In particular, the gloss level is more likely to be improved as the number of times the recording medium S passes through the fixing unit 200 increases in a state where the surface of the recording medium S on which the toner images are formed is disposed in contact with the fixing film 202.

In a case where the high-gloss mode for two-sided printing is selected, the number of times the recording medium S passes through the fixing unit 200 is not limited to three times, but instead may be desirably increased to four or more times.

(Features and Advantageous Effects of First Example Embodiment)

Figure 5:
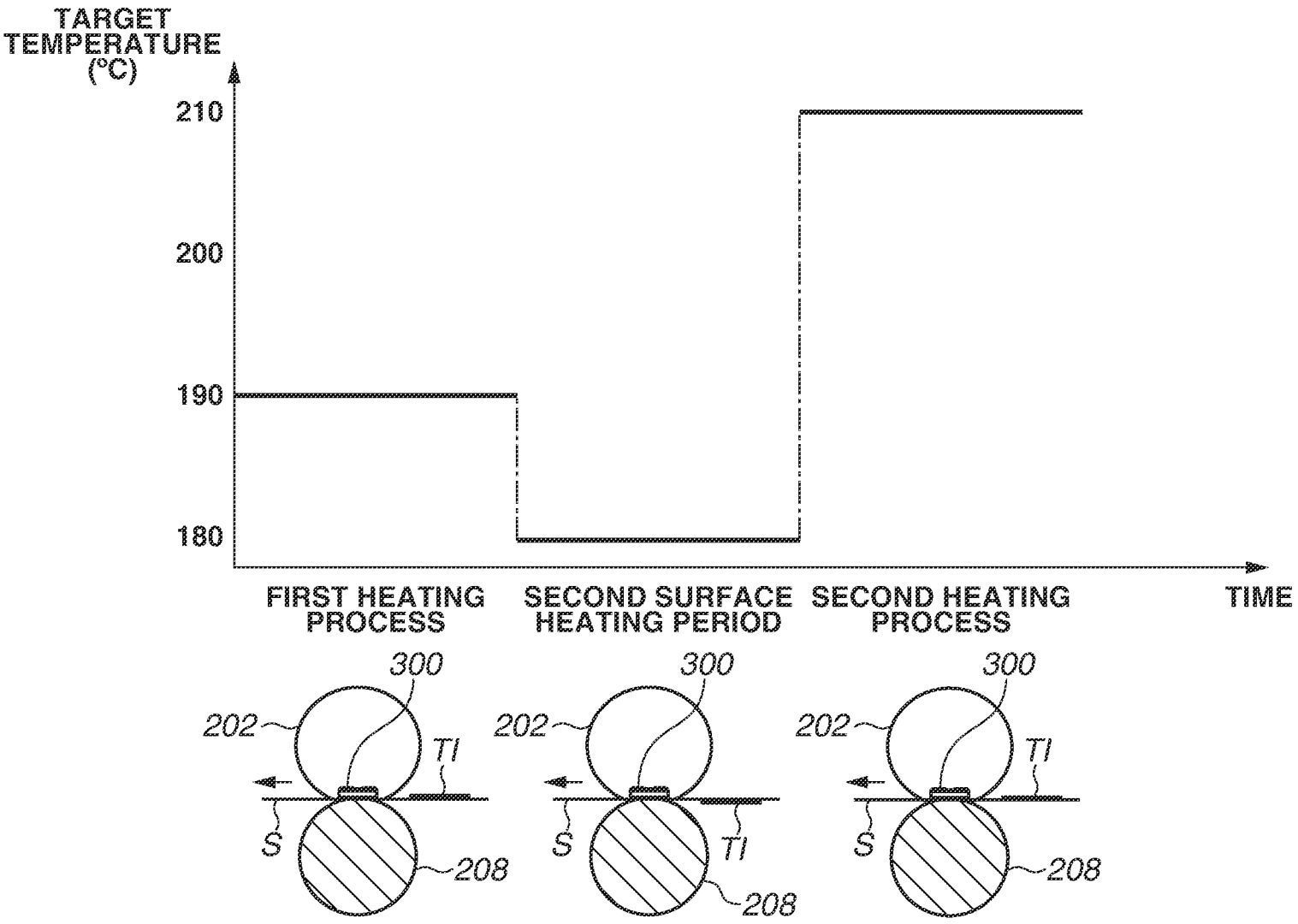
FIG. 5 is a diagram illustrating a target temperature transition in a high-gloss mode according to a first example embodiment.

FIG. 5 illustrates a relationship between a transition of the target temperature (which is substantially equal to the target temperature of the heater 300) of the fixing unit 200 when the high-gloss mode for one-sided printing is selected and the surface of the recording medium S that is in contact with the fixing film 202. A toner image TI illustrated in FIG. 5 is formed on the recording medium S. The toner image TI obtained before a first heating process is executed is unfixed, and the toner image TI obtained before the second heating process is executed is already fixed.

As illustrated in FIG. 5, when the high-gloss mode for one-sided printing is selected, the target temperature of the fixing unit 200 during the second heating process is set to a value higher than that during the first heating process. It is more preferable to set the target temperature such that the amount of heat generated during the second heating process is larger than the amount of heat generated during the first heating process.

Table 1 illustrates the target temperature, gloss, and information indicating occurrence of hot offset during the first and second heating processes. In this case, "HP Premium Presentation Paper 120 g, Glossy" was used as the recording medium S, and the conveyance speed of the recording medium S was set to 100 mm/s. The gloss level at an incident angle 75° was measured with PG-1 (manufactured by NIPPON DENSHOKU INDUSTRIES CO., LTD.). The value of the gloss level was measured at a location where the amount of toner on the recording medium S was 0.80 mg/cm$^2$.

Comparative Example 1 illustrates a case where the target temperatures during the first and second heating processes were set to the same target temperature of 190° C. In this case, the gloss level obtained after the second heating process was 60. On the other hand, in the first example embodiment, the target temperature during the second heating process was increased to 210° C., so that the gloss level obtained after the second heating process increased to 80. The target temperature of the fixing unit 200 in a second surface heating period (when the second surface of the recording medium S is heated in a state where the second surface is disposed in contact with the fixing film 202) during the first and second heating processes was set to 180° C. in each of Comparative Example 1, the first example embodiment, and Comparative Example 2 described below.

In Comparative Example 2, a target temperature was set to 210° C. from a time when the first heating process was executed, so that the gloss level obtained after a first fixing process was higher than that in the first example embodiment. However, an excess amount of heat was supplied to the unfixed toner image, and thus hot offset occurred.

The second heating process is a heating process to be performed in a state where a binding force between toner particles and a binding force between toner and the recording medium S are increased by the first heating process (fixing process for fixing the unfixed toner image). Accordingly, hot offset is less likely to occur as compared with the first heating process for heating the unfixed toner image. Thus, even when the target temperature is raised during the second heating process, a high gloss level can be obtained while the occurrence of hot offset is prevented. Hot offset was less likely to occur also during the second heating process in Comparative Example 2. However, the hot offset already occurred due to the first heating process (fixing process) and an offset image was present on the recording medium S. Therefore, it is determined that hot offset occurred.

Table 1 illustrates not only the results for the high-gloss mode, but also the results for the normal gloss mode. The gloss level in the gloss mode for one-sided printing was 45.

TABLE 1

| | First Heating Process | | | Second Heating Process | | |
|---|---|---|---|---|---|---|
| | Target Temperature | Gloss Level | Hot Offset | Target Temperature | Gloss Level | Hot Offset |
| First Example Embodiment | 190° C. | 45 | Not Occurred | 210° C. | 80 | Not Occurred |
| Comparative Example 1 | 190° C. | 45 | Not Occurred | 190° C. | 60 | Not Occurred |
| Comparative Example 2 | 210° C. | 55 | Occurred | 210° C. | 80 | Occurred |
| Normal Gloss Mode | 190° C. | 45 | Not Occurred | — | — | — |

In the present example embodiment, the target temperature of the fixing unit 200 in the second surface heating period (when the second surface of the recording medium S is heated in a state where the second surface is disposed in contact with the fixing film 202) during the first and second heating processes was set to a temperature (180° C.) lower than that during the first heating process. Alternatively, the target temperature in this period may also be set to a temperature higher than that during the first heating process.

Next, an image forming apparatus 100 according to a second example embodiment will be described. Components including identical or corresponding functions or configurations as those of the first example embodiment are denoted by the same reference numerals, and detailed descriptions thereof are omitted. The image forming apparatus 100 according to the second example embodiment, when the high-gloss mode is selected, sets a target temperature of a fixing unit 200 used during the second heating process depending on image information about toner images to be formed on a first surface of a recording medium S immediately before a first heating process.

The image fouling apparatus 100 according to the second example embodiment controls a power supply to heating blocks HB1 to HB7 depending on image data sent from an external apparatus, such as a host computer. Specifically, the target temperature (an amount of heat) in a region in which toner images on the recording medium S are not formed is set to be lower than a target temperature (an amount of heat) in a region in which the toner images are formed, thereby saving power consumption.

Figure 6:
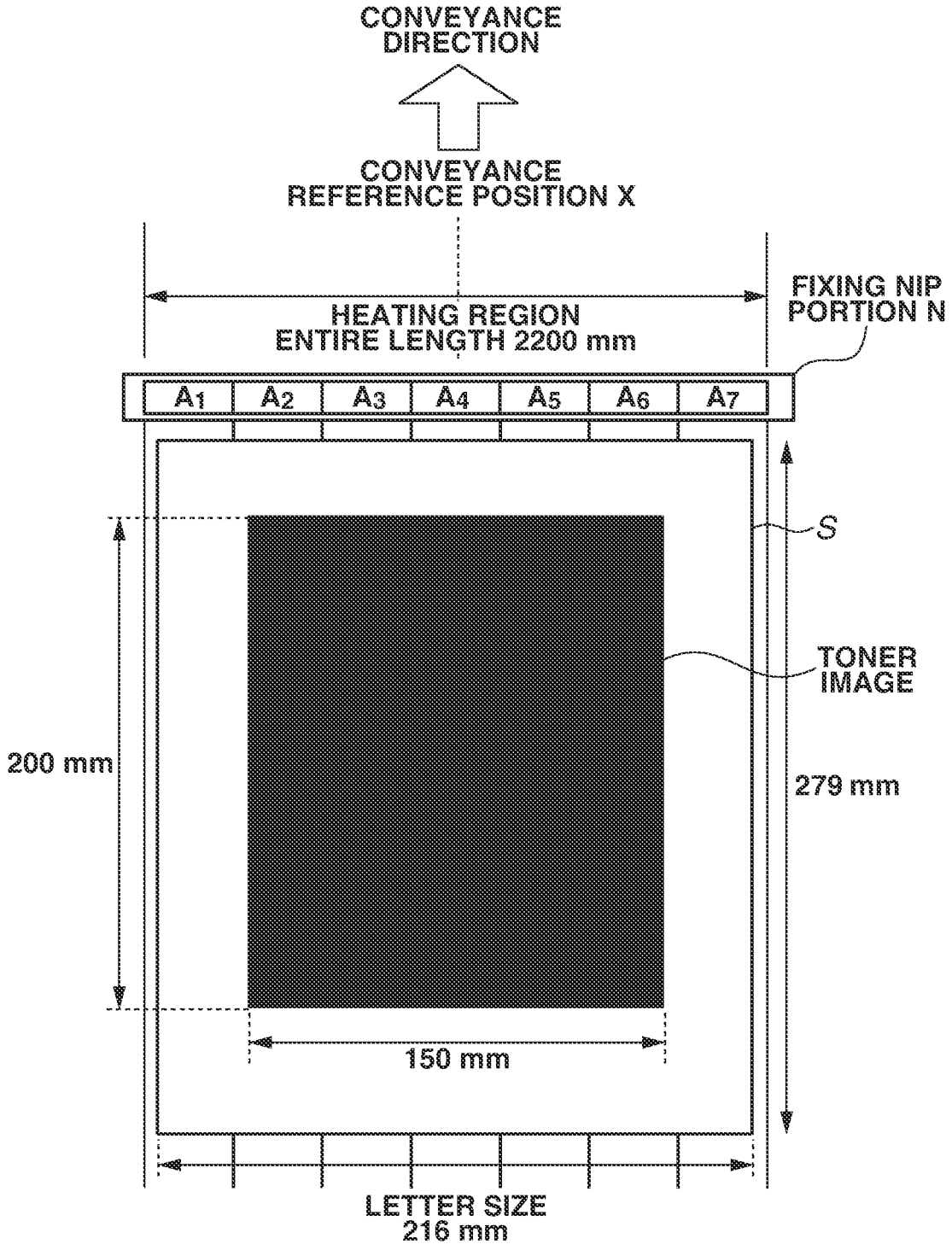
FIG. 6 illustrates a positional relationship between a heating region and an image.

FIG. 6 illustrates a positional relationship between heating regions $A_1$ to $A_7$ and an image. The heating regions $A_1$ to $A_7$ are regions to be heated by the heating blocks HB1 to HB7, respectively. The entire length of the heating regions $A_1$ to $A_7$ is 220 mm Each of the heating regions $A_1$ to $A_7$ has a width obtained by dividing a length of 220 mm equally among the seven heating regions. The recording medium S illustrated in FIG. 6 is a letter-size recording medium. Accordingly, the recording medium S has a size represented by a width of 216 mm (in a longitudinal direction of the heater 300)×a length of 279 mm (in a conveyance direction). A size of the toner image is represented by 150 mm×200 mm.

Second Example Embodiment

Figure 7:
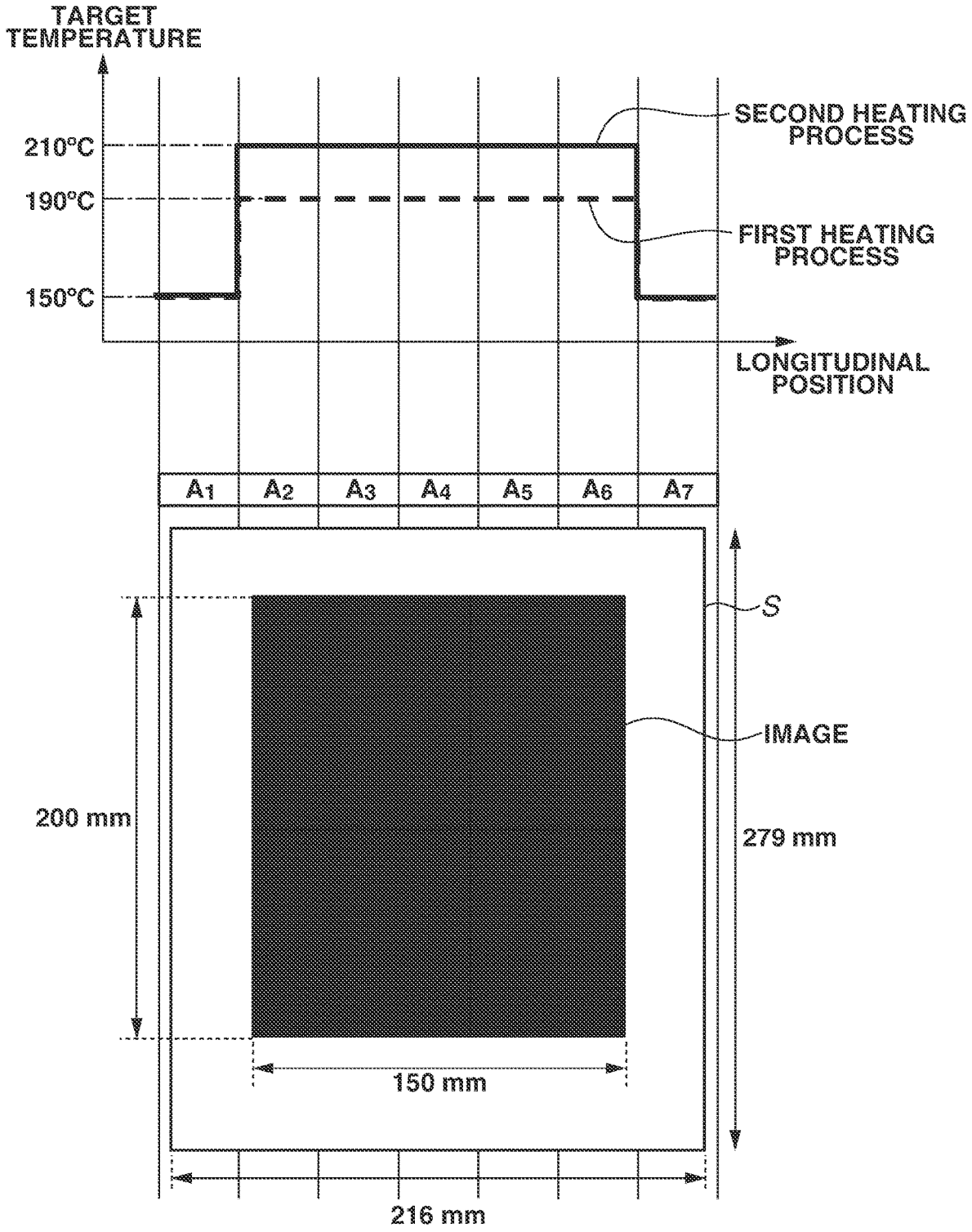
FIG. 7 illustrates a distribution of target temperatures according to a second example embodiment.

FIG. 7 illustrates a relationship between a distribution of target temperatures during a first and second heating processes in the high-gloss mode according to the second example embodiment and a position of an image on the recording medium S. In the second example embodiment, the heating process is carried out, as similarly as in the first example embodiment, during a period in which the recording medium S passes through the fixing unit 200 in a state where a first surface of the recording medium S is disposed in contact with a fixing film 202.

In the first heating process, a heating distribution is set using image information about the toner image formed on the first surface of the recording medium S immediately before the first heating process. Specifically, the target temperature for each of the heating regions $A_1$ and $A_7$ in which the image is not present (which is substantially equal to the target temperature for each of the heating blocks HB1 and HB7) is set to be lower than the target temperature for each of the heating regions $A_2$ to $A_6$ in which the image is present (the target temperature for each of the heating blocks HB2 to HB6). During the first heating process, the target temperature for each of the heating regions $A_2$ to $A_6$ was set to 190° C., and the target temperature for each of the heating regions $A_1$ and $A_7$ was set to 150° C.

When the recording medium S passes through the secondary transfer nip portion TN2 in a state where the first surface of the recording medium S is disposed to face the intermediate transfer belt 13 immediately before the second heating process is executed on the first surface of the recording medium S, the toner image is not formed on the first surface of the recording medium S. In other words, image information indicating that "no image is present in the entire area" is sent from the external apparatus at this timing. Accordingly, in a simple configuration in which the heating process is performed using image information on the first surface of the recording medium S immediately before the heating process is executed, the target temperature for all the heating regions $A_1$ to $A_7$ during the second heating process is set to a low temperature (e.g., 150° C.).

On the other hand, in the second example embodiment, the target temperature during the second heating process is set depending on the image information about the toner image to be formed on the first surface of the recording medium S immediately before the first heating process. Accordingly, in the second heating process, the target temperature for each of the heating regions $A_2$ to $A_6$ in which the toner image is present is higher than the target temperature for each of the heating regions $A_1$ and $A_7$, as similarly as in the first heating process.

As described above, according to the second example embodiment, the target temperature during the second heating process is set depending on the image information about the toner image to be formed on the first surface of the recording medium S immediately before the first heating process. Further, in the region in which the image is present, the target temperature during the second heating process is set to a temperature (210° C.) higher than that during the first heating process, as similarly as in the first example embodiment. Consequently, it is possible to obtain an image with a high gloss level while preventing the occurrence of hot offset.

In the second example embodiment, there is no need to increase the temperature of the heating region in which no image is present, unlike in the first example embodiment. Accordingly, the second example embodiment is more preferable than the first example embodiment in that the second example embodiment is excellent in energy saving. In the second example embodiment, the target temperature for each of the heating regions $A_1$ and $A_7$, each of which is a non-image region in which no image is present, during the first heating process is set to the same temperature (150° C.) as that set during the second heating process. However, the target temperature used during the first heating process may be different from the target temperature used during the second heating process. For example, an extremely large difference between the temperature of the region in which an image is present and the temperature of the non-image region may lead to a damage to the fixing film 202. Accordingly, the temperature of the non-image portion used during the second heating process may be set to be higher than the temperature of the non-image portion used during the first heating process. Further, in the second example embodiment, the distribution of target temperatures is changed in the longitudinal direction of the heater 300, while the region in which an image is present and the non-image region are distinguished from each other. Alternatively, the target temperature may be changed in the conveyance direction, while the region in which an image is present and the non-image region are distinguished from each other. Thus, in a case where the high-gloss mode is set, the image forming apparatus 100 according to the second example embodiment sets the target temperature used during the second heating process in a region including at least the toner image on the first surface to be higher than that used during the first heating process.

Also, in the second example embodiment, as similarly as in the first example embodiment, the target temperature in the second surface heating period during the first and second heating processes is set to 180° C. which is lower than the target temperature 190° C. for the region in which an image is present during the first heating process in all the heating regions $A_1$ to $A_7$. Alternatively, the target temperature in the second surface heating period may be set to a temperature higher than 190° C. Further, the target temperature for each of the heating regions $A_1$ to $A_7$ in the second surface heating period may be changed. For example, as similarly as in the first heating process on the first surface, the target temperature used in the second surface heating period for the heating regions $A_1$ and $A_7$ may be set to 150° C., and the target temperature used in the second surface heating period for the heating regions $A_2$ to $A_6$ in the second surface heating period may be set to 180° C.

Next, an image forming apparatus 100 according to a third example embodiment will be described. Like in the first and second example embodiments, components including identical or corresponding functions or configurations as those of the first and second example embodiments are denoted by the same reference numerals and detailed descriptions thereof are omitted.

The third example embodiment relates to the high-gloss mode assuming a case where an image to be formed on a first surface of the recording medium S includes a photographic image and a text image. A target temperature of a portion of the fixing unit 200 that heats a region of the photographic image is set such that the target temperature used during a second heating process is higher than that used during a first heating process. On the other hand, the target temperature of a portion of the fixing unit 200 that heats a region of the text image is set such that the target temperature used during the second heating process is lower than that used during the first heating process.

Third Example Embodiment

Figure 8:
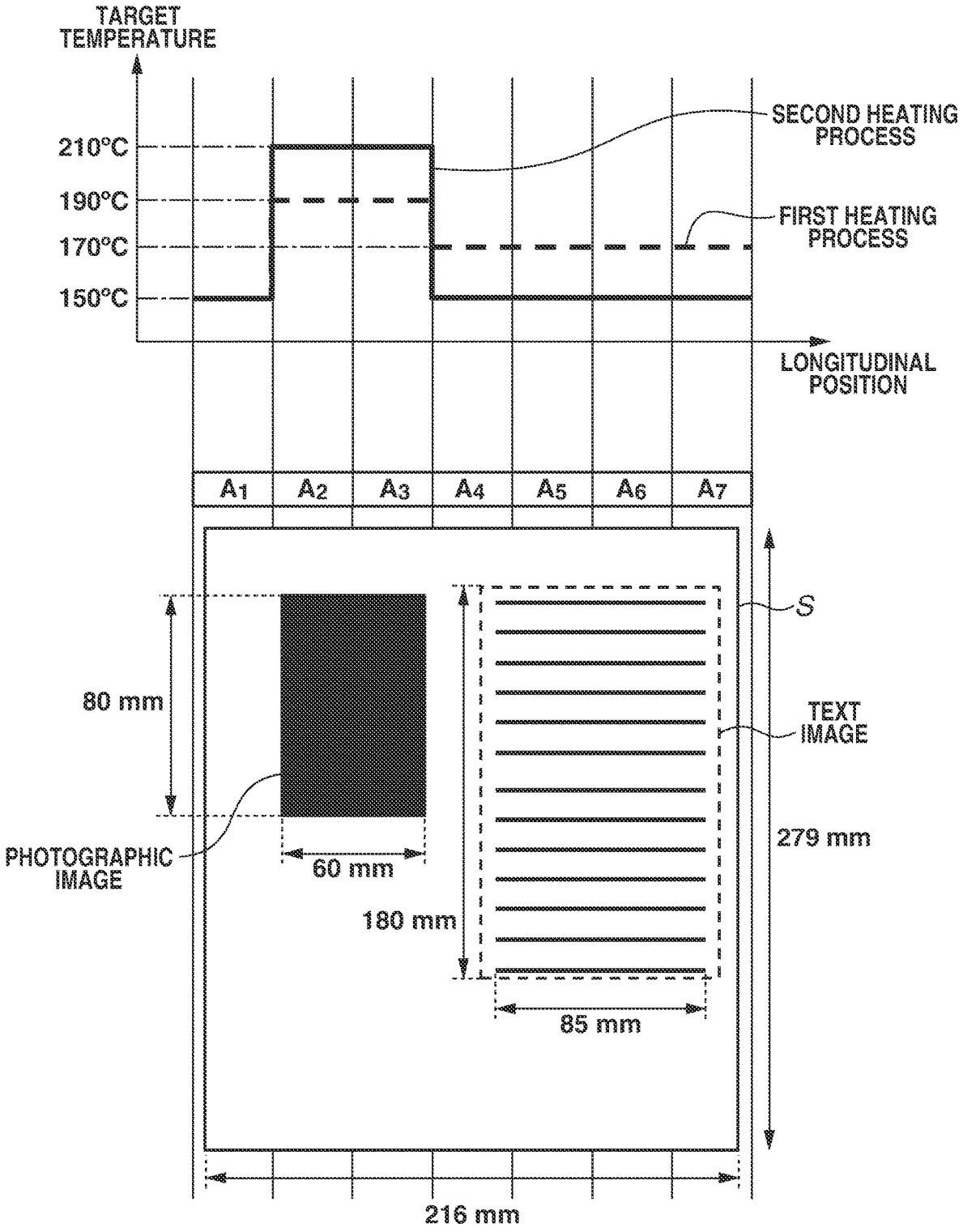
FIG. 8 illustrates a relationship between images and a distribution of target temperatures assumed in a third example embodiment.

FIG. 8 illustrates a relationship between a distribution of target temperatures used during the first and second heating processes according to the third example embodiment and a position of an image on the recording medium S. In general, a photographic image with a higher gloss level is preferred. However, since a text image with a lower gloss level can be more easily read, it is desirable not to set an extremely high gloss for the text image.

Referring to FIG. 8, the photographic image (e.g., 60 mm×80 mm) is present within a range of heating regions $A_2$ and $A_3$. The text image (e.g., 85 mm×180 mm) is present within a range of heating regions $A_4$ to $A_7$. As illustrated in Table 2, in the third example embodiment, the target temperature used during the first heating process for each of the heating regions $A_2$ and $A_3$ is set to 190° C., and the target temperature used during the second heating process is set to 210° C. The target temperature used during the second heating process is set to be higher than the target temperature used during the first heating process. Accordingly, a gloss level obtained after the second heating process was 80. On the other hand, there is no need to increase a gloss level in the heating regions $A_4$ to $A_7$, and thus the target temperature in the heating regions $A_4$ to $A_7$ may be set to a temperature at which the text image can be fixed. For this reason, 170° C., which is lower than the target temperature for each of the heating regions $A_2$ and $A_3$, was set as a first target temperature. Since the text image is already fixed onto the recording medium S during the first fixing process, the target temperature may be further lowered during the second fixing process. Accordingly, the target temperature during the second heating process was set to 150° C. As a result, a gloss level of the text image portion obtained after the second heating process was 40, which was a value lower than that of the photographic image portion.

In Comparative Example 3, the target temperature for the photographic image portion was set to be the same as the target temperature for the text image portion. The first target temperature was set to 190° C., and a second target temperature was set to 210° C. Consequently, the text image portion also had a high gloss level of 80, which was equal to the gloss level of the photographic image portion.

TABLE 2

| | Photographic Image Portion | | Text Image portion | |
|---|---|---|---|---|
| | Target Temperature | Gloss Level | Target Temperature | Gloss Level |
| | First | | | |
| Third Example Embodiment | 190° C. | 45 | 170° C. | 30 |
| Comparative Example 3 | 190° C. | 45 | 190° C. | 45 |
| | Second | | | |
| Third Example Embodiment | 210° C. | 80 | 150° C. | 40 |
| Comparative Example 3 | 210° C. | 80 | 210° C. | 80 |

Fourth Example Embodiment

Next, an image forming apparatus 100 according to a fourth example embodiment will be described. Components including identical or corresponding functions or configurations as those of the first to third example embodiments are denoted by the same reference numerals and detailed descriptions thereof are omitted.

The fourth example embodiment is similar to the second and third example embodiments in that a target temperature of a fixing unit 200 during a second heating process in the high-gloss mode is determined using image information about a toner image to be formed on a recording medium S before a first heating process.

The fourth example embodiment relates to the high-gloss mode assuming a case where it can be determined, based on image information, whether an image to be formed on a first surface of the recording medium S includes an image in which hot offset is likely to occur. Examples of the image in which hot offset is likely to occur include a low-density halftone image in which a binding force between toner particles is less likely to act. Assume that an image density of each color on the recording medium S in the image forming apparatus 100 according to the fourth example embodiment is 0%, in a case where no toner is present on the recording medium S. The image density is 100% in a case where the amount of toner on the recording medium S is 0.40 mg/cm$^2$.

In the fourth example embodiment, in a case where it is determined that a low-density image is present, the target temperature during the first and second heating processes is set to be lower than that in a case where it is determined that the low-density image is not present. In addition, a number of heating processes to be performed when it is determined that the low-density image is present is set to be greater than a number of heating processes to be performed when it is determined that the low-density image is not present.

A threshold density is predetermined in the image forming apparatus 100. In the fourth example embodiment, a threshold density is 40%. At a density less than or equal to the threshold density, hot offset is likely to occur, and the density varies depending on toner to be used or fixing conditions. Accordingly, the threshold density is not limited to this value.

Figure 9:
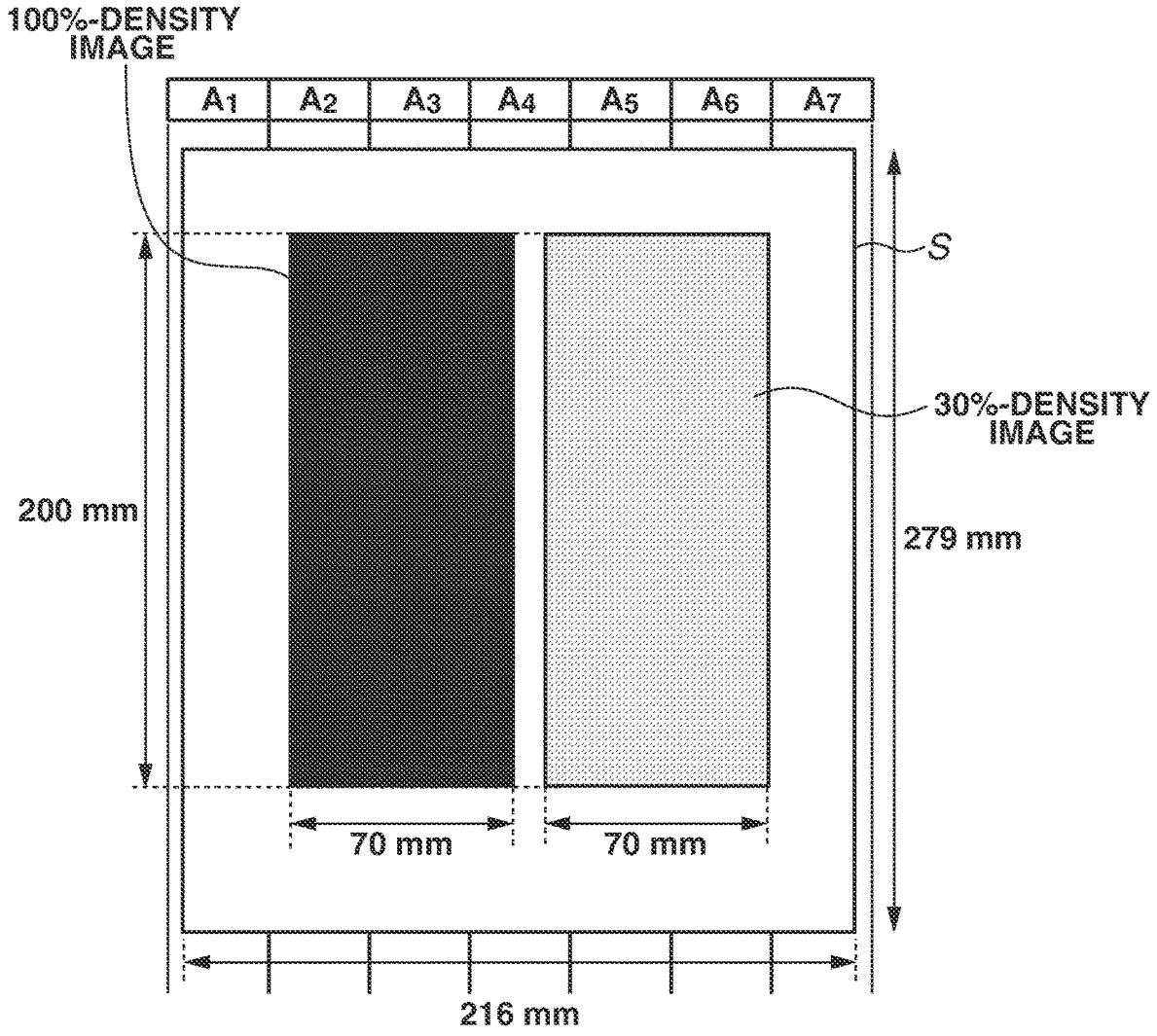
FIG. 9 illustrates images assumed in a fourth example embodiment.

As illustrated in FIG. 9, assume a case where a recording medium S on which an image with an image density of 30% and a toner image with a density of 100% are formed is processed in the high-gloss mode. Both the 30%-density image and the 100%-density image have a size of 70 mm (in the longitudinal direction of a heater 300)×200 mm (in the conveyance direction).

Table 3 illustrates results of setting and an offset state during the heating process in the fourth example embodiment 4 and Comparative Examples 4 and 5. A gloss level was measured in an image portion with a density of 100%, and an occurrence of hot offset was evaluated in an image portion with a density of 30%.

In Comparative Example 4, since the target temperature during the first heating process was set to 190° C., hot offset occurred in the image portion with a density of 30% on the fixing film 202. In Comparative Example 5, a target temperature during a first heating process was lowered to 180° C., to thereby prevent an occurrence of hot offset during a first heating process. However, since a target temperature during a second heating process was raised to 210° C., hot offset occurred.

On the other hand, in the present example embodiment, it was determined that a low-density image with a density lower than the threshold density was present based on the image information about the first surface. Accordingly, a target temperature during the first heating process was set to 180° C., and a target temperature during the second heating process was set to 190° C., thereby preventing an occurrence of hot offset. However, a gloss level was not increased to a sufficiently high level even after the heating process was executed twice, and thus an effect of the high-gloss mode was insufficient. Accordingly, the recording medium S was conveyed to the fixing unit 200 again (in a state where the first surface faces the fixing film 202) and a number of heating processes was increased, thereby obtaining an image with a high gloss level. A target temperature during the third heating process was set to 190° C., which was the same as the target temperature during the second heating process.

If the gloss level is not sufficiently high even after the recording medium S has passed through the fixing unit 200 third time, the number of times the recording medium S passes through the fixing unit 200 may be increased. Table 3 illustrates the results of measurement of the gloss level of the portion with the image density of 100%. However, the advantageous effect of improving the gloss level can also be obtained in a halftone portion with the image density of 30%.

In the fourth example embodiment, in a case where it is determined that the image on the first surface does not include a low-density image with a density lower than the threshold density, the same temperature and the same number of heating processes as those of Comparative Example 4 are set.

TABLE 3

| | First Heating Process | | | Second Heating Process | | |
|---|---|---|---|---|---|---|
| | Target Temperature | Gloss Level | Hot Offset | Target Temperature | Gloss Level | Hot Offset |
| Fourth Example Embodiment | 180° C. | 40 | Not Occurred | 190° C. | 60 | Not Occurred |
| Comparative Example 4 | 190° C. | 45 | Occurred | 210° C. | 80 | Occurred |
| Comparative Example 5 | 180° C. | 40 | Not Occurred | 210° C. | 80 | Occurred |

TABLE 3-continued

| | Third Heating Process | | |
|---|---|---|---|
| | Target Temperature | Gloss Level | Hot Offset |
| Fourth Example Embodiment | 190° C. | 80 | Not Occurred |
| Comparative Example 4 | — | — | — |
| Comparative Example 5 | — | — | — |

Next, an image forming apparatus 100 according to a fifth example embodiment will be described. Components including identical or corresponding functions or configurations as those of the first to fourth example embodiments are denoted by the same reference numerals and detailed descriptions thereof are omitted.

Fifth Example Embodiment

The fifth example embodiment relates to the high-gloss mode assuming a case where an unfixed toner image is secondarily transferred onto a first surface of a recording medium S twice.

When the high-gloss mode for one-sided printing is selected, an unfixed toner image is first transferred onto the first surface of the recording medium 5, like in normal one-sided printing, and then the heating process is performed by a fixing unit 200. Like in normal two-sided printing, the recording medium S is reversely conveyed by discharge rollers 21, passes through a duplex conveyance path in which duplex conveyance rollers 18 are disposed, and is then conveyed to a secondary transfer portion again. Image formation is not performed on a second surface of the recording medium S. and the recording medium S is directly conveyed to the fixing unit 200. In the high-gloss mode, the discharge rollers 21 are rotated backward again in a state where the recording medium S is nipped, and the recording medium S is conveyed to the duplex conveyance rollers 18. The above-described processes are similar to those in the first to fourth example embodiments.

In the fifth example embodiment, when the recording medium S is conveyed to the secondary transfer portion again, an unfixed toner image is transferred onto the first surface of the recording medium S. In other words, the unfixed toner image is transferred onto the toner image subjected to the heating process once, or onto the recording medium S. The recording medium S is heated by the fixing unit 200, and is then discharged to an outside of the image forming apparatus 100 by the discharge rollers 21.

According to the fifth example embodiment, the secondary transfer process is executed twice, i.e., a first secondary transfer process and a second secondary transfer process are executed, so that a high-gloss portion and a low-gloss portion can be selectively obtained on the recording medium S.

Figure 10:
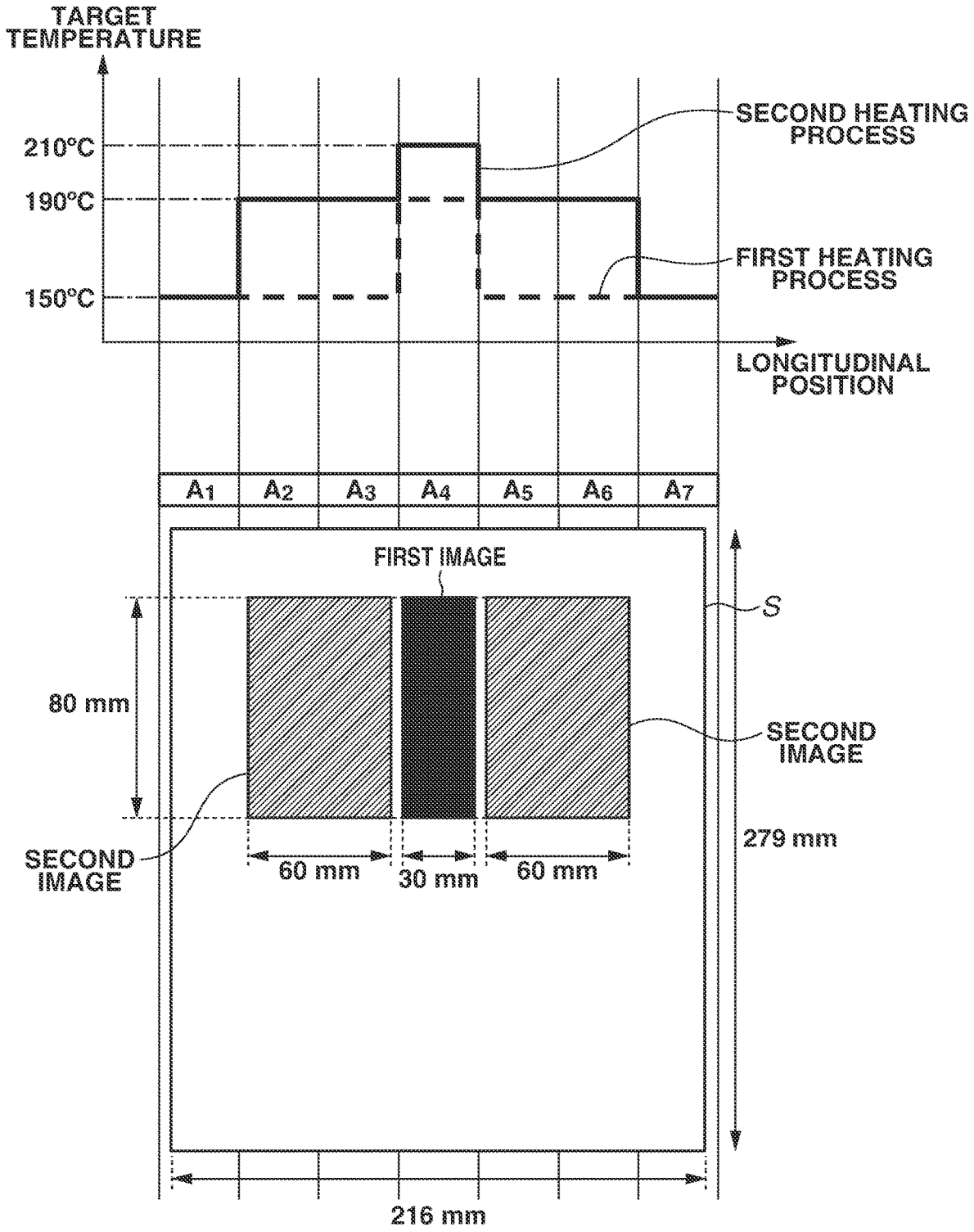
FIG. 10 illustrates a relationship between images and a distribution of target temperatures assumed in a fifth example embodiment.

FIG. 10 illustrates a relationship between a distribution of target temperatures during the first and second heating processes according to the fifth example embodiment and positions of a first secondarily-transferred image (first image portion) and a second secondarily-transferred image (second image portion).

Referring to FIG. 10, a first image portion (e.g., 30 mm×80 mm) is present within the range of the heating region $A_4$. Second image portions (e.g., 60 mm×80 mm) is present within the range of the heating regions $A_2$, $A_3$, $A_5$, and $A_6$. As illustrated in Table 4, in the fifth example embodiment, the target temperature during the first heating process for the heating region $A_4$ was set to 190° C., and the target temperature during the second heating process was set to 210° C. The target temperature during the second heating process was set to be higher than that during the first heating process. As a result, the gloss level obtained after the second heating process was 80. On the other hand, in the heating regions $A_2$ to $A_3$, $A_5$ to $A_6$, no image was present during the first heating process, the target temperature during the first heating process was set to 150° C. Since an image was present during the second heating process, the target temperature during the second heating process was set to 190° C. As a result, the gloss level obtained after the second heating process was 45. Thus, a difference between the gloss level of the first image portion and the gloss level of the second image portion was 35.

Comparative Example 6 illustrates a case where a target temperature during the first and second heating processes was set to a same target temperature of 190° C. A gloss level obtained after a second heating process in a first image portion was 60, and a gloss level obtained after a second heating process in a second image portion was 45. Thus, a difference between the gloss level of the first image portion and the gloss level of the second image portion was 15.

As described above, in the case of forming an image twice on the first surface of the recording medium S, the target temperature during the second heating process is set using two pieces of image information, i.e., image information about the image to be secondarily transferred onto the recording medium S in the first secondary transfer process, and image information about the image to be secondarily transferred onto the recording medium S in the second secondary transfer process. Consequently, in the fifth example embodiment, a remarkable difference between the gloss level of the first image portion and the gloss level of the second image portion was obtained as compared with the difference obtained in Comparative Example 6.

Referring to FIG. 10, the first image portion and the second image portion do not overlap each other. However, the second image portion may be formed on the first image portion. Even in this case, the portion in which the second image is formed has a gloss level lower than that in the portion in which only the first image is formed. Accordingly, a remarkable difference in gloss level is obtained by setting the target temperature for only the portion in which the first image is formed to a higher temperature.

TABLE 4

| | First | | | |
|---|---|---|---|---|
| | First Image Portion | | Second Image Portion | |
| | Target Temperature | Gloss Level | Target Temperature | Gloss Level |
| Fifth Example Embodiment | 190° C. | 45 | 150° C. | No Image |
| Comparative Example 6 | 190° C. | 45 | 190° C. | No Image |

TABLE 4-continued

| | Second | | | |
|---|---|---|---|---|
| | First Image Portion | | Second Image Portion | |
| | Target Temperature | Gloss Level | Target Temperature | Gloss Level |
| Fifth Example Embodiment | 210° C. | 80 | 190° C. | 45 |
| Comparative Example 6 | 190° C. | 60 | 190° C. | 45 |

The fixing unit 200 according to the first to fifth example embodiments described above incorporates the heater 300 including the plurality of heating blocks HB1 to HB7 which can be controlled independently. However, the high-gloss mode in the example embodiments described above can also be applied to an image forming apparatus incorporating a heater that is not divided into a plurality of heating blocks in the longitudinal direction of the heater.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Applications No. 2019-061879, filed Mar. 27, 2019, and No. 2020-017483, filed Feb. 4, 2020, which are hereby incorporated by reference herein in their entirety.

What is claimed is:

1. An image forming apparatus to form a toner image on a recording medium, the image forming apparatus comprising:

an image forming unit configured to form the toner image on the recording medium;

a fixing unit configured to fix the toner image formed on the recording medium onto the recording medium by executing a heating process for heating the recording medium while the recording medium is nipped and conveyed at a fixing nip portion, wherein the fixing unit includes a heater, a first rotary member to be heated by the heater, and a second rotary member configured to form the fixing nip portion in cooperation with the first rotary member; and a controller configured to set a target temperature of the fixing unit in accordance with image information about the toner image, wherein the image forming apparatus is configured to set a mode in which, after the toner image is formed on a first surface of the recording medium by the image forming unit, a first heating process and a second heating process after the first heating process are performed on the same recording medium with the first surface of the recording medium in contact with the first rotary member, and wherein, in a case where the mode is set, the controller sets the target temperature at a time of the second heating process by the same fixing unit as the fixing unit used for the first heating process depending on the image information about the toner image to be formed on the first surface of the recording medium immediately before the first heating process.

2. The image forming apparatus according to claim 1, wherein, in the case where the mode is set, the target temperature during the second heating process in a region including at least the toner image on the first surface of the recording medium is set to be higher than the target temperature during the first heating process.

3. The image forming apparatus according to claim 1, wherein, in a case where the mode is set and the toner image to be formed on the first surface of the recording medium includes a photographic image and a text image, the target temperature during the second heating process in a portion of the fixing unit that heats a region of the photographic image is set to be higher than the target temperature during the first heating process, and wherein the target temperature during the second heating process in a portion of the fixing unit that heats a region of the text image is set to be lower than the target temperature during the first heating process.

4. The image forming apparatus according to claim 1, wherein, in a case where it is determined that the toner image to be formed on the first surface of the recording medium includes a low-density image having a density lower than a threshold density, the target temperature during the first heating process and the second heating process is set to be lower than the target temperature to be set in a case where it is determined that the low-density image is not present.

5. The image forming apparatus according to claim 1, wherein a number of times of the heating process to be performed in a case where it is determined that the toner image to be formed on the first surface of the recording medium includes a low-density image having a density lower than a threshold density is set to be greater than a number of times of the heating process to be performed in a case where it is determined that the low-density image is not present.

6. The image forming apparatus according to claim 1, wherein the image forming apparatus (i) includes a duplex conveyance path for reversing a surface of the recording medium to come into contact with the first rotary member, and (ii) controls the recording medium to be conveyed such that the recording medium passes through the duplex conveyance path twice so that the first surface of the recording medium comes into contact with the first rotary member during the second heating process.

7. The image forming apparatus according to claim 1, wherein the first rotary member is a tubular film.

8. The image forming apparatus according to claim 7, wherein the heater is in contact with an inner surface of the tubular film.

9. The image forming apparatus according to claim 7, wherein the fixing nip portion is formed by the heater and the second rotary member via the tubular film.

10. The image forming apparatus according to claim 1, wherein the heater includes a plurality of heating blocks configured to be independently controllable, and the plurality of heating blocks is arranged in a longitudinal direction of the heater.

11. An image forming apparatus to form a toner image on a recording medium, the image forming apparatus comprising:

an image forming unit configured to form the toner image on the recording medium;

a fixing unit configured to fix the toner image formed on the recording medium onto the recording medium by executing a heating process for heating the recording medium while the recording medium is nipped and conveyed at a fixing nip portion, wherein the fixing unit includes a heater having a first heating block configured to generate heat by electrical power to be supplied and a second heating block configured to generate heat by electrical power to be supplied, a first rotary member to be heated by the heater, and a second rotary member configured to form the fixing nip portion in cooperation with the first rotary member;

a first switch configured to switch a power supply state to the first heating block;

a second switch configured to switch a power supply state to the second heating block; and a controller configured to control the first switch and to control the second switch independently of the control of the first switch, wherein the first and second heating blocks are arranged in a longitudinal direction of the heater that is a direction perpendicular to a recording medium conveying direction, wherein the image forming apparatus is configured to set a mode in which, after the toner image is formed on a first surface of the recording medium by the image forming unit, a first heating process and a second heating process after the first heating process are performed on the same recording medium with the first surface of the recording medium in contact with the first rotary member, and wherein, in a case where the mode is set, the controller sets target temperatures of each of first and second regions heated by the first and second heating blocks at a time of the second heating process by the same fixing unit as the fixing unit used for the first heating process depending on the image information about the toner image to be formed on the first surface of the recording medium immediately before the first heating process.

12. The image forming apparatus according to claim 11, wherein, in the case where the mode is set, the target temperature during the second heating process in a region including at least the toner image on the first surface of the recording medium is set to be higher than the target temperature during the first heating process.

13. The image forming apparatus according to claim 11, wherein, in a case where the mode is set and the toner image to be formed on the first surface of the recording medium includes a photographic image and a text image, the target temperature during the second heating process in a portion of the fixing unit that heats a region of the photographic image is set to be higher than the target temperature during the first heating process, and wherein the target temperature during the second heating process in a portion of the fixing unit that heats a region of the text image is set to be lower than the target temperature during the first heating process.

14. The image forming apparatus according to claim 11, wherein, in a case where it is determined that the toner image to be formed on the first surface of the recording medium includes a low-density image having a density lower than a threshold density, the target temperature during the first heating process and the second heating process is set to be lower than the target temperature to be set in a case where it is determined that the low-density image is not present.

15. The image forming apparatus according to claim 11, wherein a number of times of the heating process to be performed in a case where it is determined that the toner image to be formed on the first surface of the recording medium includes a low-density image having a density lower than a threshold density is set to be greater than a number of times of the heating process to be performed in a case where it is determined that the low-density image is not present.

16. The image forming apparatus according to claim 11, wherein the image forming apparatus (i) includes a duplex conveyance path for reversing a surface of the recording medium to come into contact with the first rotary member, and (ii) controls the recording medium to be conveyed such that the recording medium passes through the duplex conveyance path twice so that the first surface of the recording medium comes into contact with the first rotary member during the second heating process.

17. The image forming apparatus according to claim 11, wherein the first rotary member is a tubular film.

18. The image forming apparatus according to claim 17, wherein the heater is in contact with an inner surface of the tubular film.

19. The image forming apparatus according to claim 17, wherein the fixing nip portion is formed by the heater and the second rotary member via the tubular film.

* * * * *